United States Patent [19]

Hoerkens

[11] Patent Number: 4,803,853

[45] Date of Patent: Feb. 14, 1989

[54] ORNAMENTAL EAR INSERT AND HEARING AID

[76] Inventor: Reiner Hoerkens, Bahnhofstrasse 31, D-6903 Neckargemünd, Fed. Rep. of Germany

[21] Appl. No.: 70,917

[22] Filed: Jul. 8, 1987

[30] Foreign Application Priority Data

Jul. 16, 1986 [DE] Fed. Rep. of Germany ... 8619008[U]

[51] Int. Cl.[4] ..... A44C 7/00; A44C 25/00

[52] U.S. Cl. ..... 63/14.1; 63/2; 381/68.6; 381/187

[58] Field of Search ..... 63/14 A, 2, 14 R, 14.1, 63/14.2, 12, DIG. 2, 14.3, 14.4, 14.5, 14.6, 14.7, 14.8; 381/68.6, 187; 204/18.1, 24, 32, 16; 2/423

[56] References Cited

U.S. PATENT DOCUMENTS

| | | | |
|---|---|---|---|
| 195,324 | 9/1877 | Atkinson | 63/DIG. 2 |
| 1,602,847 | 10/1926 | Dover | 63/2 |
| 2,410,914 | 11/1946 | Williams | 63/14.2 |
| 2,477,046 | 7/1949 | Davenport | 381/68.6 X |
| 2,532,852 | 12/1950 | Oaks | 2/423 |
| 2,595,672 | 5/1952 | Greenwood | 63/14.1 X |
| 3,053,619 | 9/1962 | French | 63/14.1 |
| 4,543,803 | 10/1985 | Keyasko | 63/12 |

FOREIGN PATENT DOCUMENTS

| | | | |
|---|---|---|---|
| 161942 | 3/1955 | Australia | 63/14 A |

OTHER PUBLICATIONS

Modern Plastics, Jun. 1946, pp. 120–122.

*Primary Examiner*—Richard J. Johnson
*Attorney, Agent, or Firm*—Balogh, Osann, Kramer, Dvorak, Genova & Traub

[57] ABSTRACT

An ornamental ear insert is provided which comprises a mesh screen, which particularly consists of metal and is formed with pleats, which are preferably curved. The ornamental ear insert in accordance with the invention is adapted to be inserted into an external ear and is adapted to be resiliently retained behind projecting portions of the external ear and/or may be provided at one end or at both ends with hooks for insertion into folds between the external ear and the skull of the wearer. Such an ornamental insert may be used merely as an ornament or as an ornamental covering for a hearing aid or a component thereof and may be designed to leave free the ear lobe for an attachment of conventional ear ornament.

11 Claims, 1 Drawing Sheet

ORNAMENTAL EAR INSERT AND HEARING AID

BACKGROUND OF THE INVENTION

Field of the Invention

This invention relates to an ornamental ear insert and to a combination of an ornamental ear insert and a hearing aid.

SUMMARY OF THE INVENTION

The ornamental ear insert comprises a mesh screen, which particularly consists of metal and is formed with pleats, which are preferably curved. The ornamental ear insert in accordance with the invention is adapted to be inserted into an external ear and is adapted to be resiliently retained behind projecting portions of the external ear and/or may be provided at one end or at both ends with hooks for insertion into folds between the external ear and the skull of the wearer. Such an ornamental insert may be used merely as an ornament or as an ornamental covering for a hearing aid or a component thereof and may be designed to leave free the ear lobe for an attachment of conventional ear ornament.

The pleats form in the mesh screen may be similar to the flutes of messel shells or may radiate. Beadlike arches may be provided between the pleats to ensure a high flexibility in combination with an adequate stability.

DETAILED DESCRIPTION OF THE PREFERRED EMBODIMENTS

Preferred embodiments of the ornamental ear insert in accordance with the invention will now be described more in detail with reference to the drawings.

Figure 2:
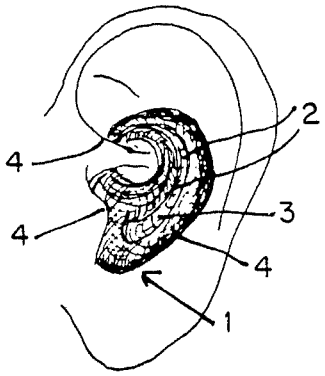
FIGS. 1 and 2, respectively, show an ornamental ear insert consisting of a mesh screen before and after it has been inserted into the external ear.
Figure 1:
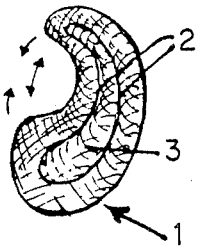

The ornamental ear insert shown in the drawings comprises a mesh screen 1, particularly a metal mesh screen, which is formed with pleats 2, which are preferably curved. Beadlike arches 3 are formed in the screen 1 between the pleats and ensure that the screen has a high flexibility and an adequate stability. As a result, the mesh screen can be radially compressed and can be inserted into the external ear in the resulting shape and can then be released for a resilient expansion behind the projecting portions 4 of the external ear so that the ornamental ear insert will be retained in the external ear as shown in FIGS. 1 and 2.

Figure 4:
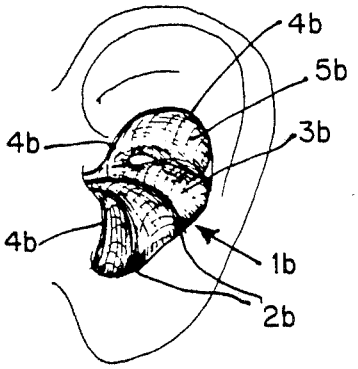
FIGS. 3 and 4, respectively, show different mesh screens before and after they have been inserted into the external ear.
Figure 3:
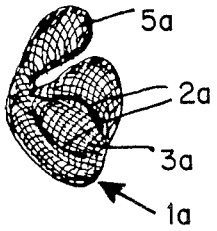

FIGS. 3 and 4 show two other embodiments of mesh screens 1*a* and 1*b*, respectively, which are formed with pleats 2*a* or 2*b* and with arches 3*a* or 3*b*. In FIGS. 3 and 4 said ornamental ear inserts are respectively shown before and after they have been inserted into the external ear. The flexibility of the ornamental ear inserts 1*a* and 1*b* shown in FIGS. 3 and 4 has been increased by a mesh lug 5*a*, 5*b*, which generally conforms to a portion of the external ear.

Figure 6:
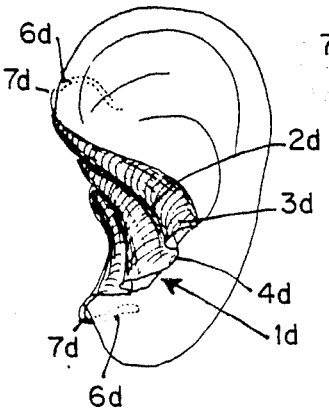
FIGS. 5 and 6 show various ornamental mesh screens inserted into the external ear.
Figure 5:
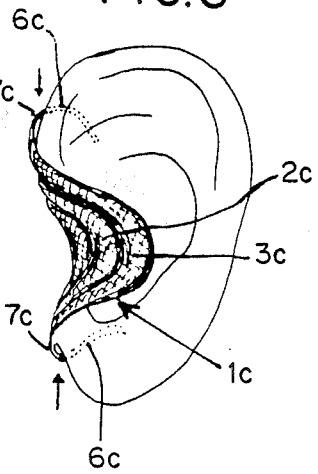

FIGS. 5 and 6 show two additional embodiments of mesh screens 1*c* and 1*d*, respectively, which are formed with pleats 2*c* and 2*d* and with arches 3*c* and 3*d* and are shown after they have been inserted into the external ear. The mesh screen 1*c* shown in FIG. 5 is provided with top and bottom hooks 6*c*, which have been inserted into the folds 7*c* between the external ear and the skull. The mesh screen 1*d* shown in FIG. 6 is provided with top and bottom hooks 6*d*, which have been inserted into the folds 7*d* between the external ear and the skull.

The mesh screens 1, 1*a*, 1*b*, 1*c*, 1*d* may be used merely for ornamental purposes but may also be used as an ornamental covering to conceal a hearing aid or part thereof and may be secured to the latter. The volume control device of the hearing aid may be operable by a coupling pin, which extends through the mesh screen and outside the latter carries an ornamental knob or a pearl knob for rotating the coupling pin. This is not shown here.

A battery for powering such hearing aid may be worn behind the external ear and may be electrically connected to the hearing aid in the external ear by leads which may be concealed by end portions of the mesh screen and/or by hooks which are connected to the mesh screen and inserted into folds between the external ear and the skull. In a hearing aid comprising a speaker inserted into the external ear and a unit worn behind the ear, a lead between said unit and the speaker may be concealed by end portions of the mesh screen and/or by hooks which are connected to the mesh screen and inserted into the folds between the external ear and the skull. The mesh screen may be secured to a hearing aid to form a unit which is inserted into the external ear and can be removed from the external ear by means of the mesh screen.

The mesh screen formed with pleats may particularly consist of a fine-mesh screen and may be formed at its edge with an inturned bead or with a plastic rim. The ornamental ear device may comprise a mesh screen consisting of metal-coated plastic, particularly if the mesh screen is combined with a hearing aid or part thereof.

The ornamental ear insert in accordance with the invention permits hearing aids to be worn inconspicuously and permits additional and novel features to be embodied in hearing aids, e.g., in that parts of the hearing aid are worn behind the external ear and the lead from said parts behind the ear to the parts worn in the external ear may be concealed and such parts worn behind the ear may be larger than parts which could be inserted into the external ear.

The surface of the mesh screen is increased by the beadlike arches so that the mesh screen will not adversely affect the transmission of sound to the ear in which the ornamental ear insert is worn.

I claim:

1. An ornamental ear insert comprising a flexible mesh screen formed to possess at least one pleat, said mesh screen being configured to the wearer's external ear to engage the inner portion of the ear adjoining the ear canal, said mesh screen having predetermined curvilinear portions for engaging projecting portions of said external ear, thereby securing said ear insert to said external ear.

2. An ornamental ear insert according to claim 1, wherein the mesh screen consists of metal.

3. An ornamental ear insert according to claim 1, wherein said pleats are curved.

4. An ornamental ear insert according to claim 1, wherein said pleats are curved like the flutes of a mussel shell.

5. An ornamental ear insert according to claim 1, wherein said mesh screen is formed with radiating pleats.

6. An ornamental ear insert according to claim 1, wherein said mesh screen is formed with beadlike arches between said pleats.

7. An ornamental ear insert according to claim 1, wherein said mesh screen is resilient and adapted to be retained behind inwardly projecting portions of an external ear.

8. An ornamental ear insert according to claim 1, wherein mesh lugs for insertion behind projecting portions of the external ear are provided on said mesh screen.

9. An ornamental ear insert according to claim 1, wherein said mesh screen has a welded rim.

10. An ornamental ear insert according to claim 1 wherein said mesh screen is provided with a plastic rim.

11. An ornamental ear insert according to claim 1, wherein said mesh screen consists of metallized plastic.

* * * * *